US007531760B1

(12) United States Patent
Whipple et al.

(10) Patent No.: US 7,531,760 B1
(45) Date of Patent: May 12, 2009

(54) OPERATING HANDLE LOCKING APPARATUS AND ELECTRICAL SWITCHING APPARATUS INCLUDING THE SAME

(75) Inventors: Michael J. Whipple, New Sewickley Township, PA (US); Luis E. Betances, Santo Domingo (DO)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/972,031

(22) Filed: Jan. 10, 2008

(51) Int. Cl.
*H01H 9/28* (2006.01)

(52) U.S. Cl. ..... 200/43.19; 200/43.01; 335/172; 335/23

(58) Field of Classification Search ... 200/43.14–43.25, 200/43.01; 335/8–10, 23–25, 42, 172–176
See application file for complete search history.

(56) References Cited

U.S. PATENT DOCUMENTS

| | | | | |
|---|---|---|---|---|
| 2,849,552 | A | 8/1958 | Firestone | |
| 2,937,248 | A | 5/1960 | Michetti | |
| 3,214,530 | A | 10/1965 | Tharp et al. | |
| 3,408,466 | A | 10/1968 | Palmer | |
| 4,347,412 | A | 8/1982 | Mihara et al. | |
| 4,581,502 | A | 4/1986 | Grudzinskas | |
| 4,691,180 | A * | 9/1987 | Grunert et al. | 335/6 |
| 5,147,991 | A | 9/1992 | Jordan, Sr. | |
| 5,150,092 | A * | 9/1992 | Kolb | 335/132 |
| 5,219,070 | A | 6/1993 | Grunert et al. | |
| 5,310,969 | A | 5/1994 | Turek et al. | |
| 5,341,191 | A | 8/1994 | Crookston et al. | |
| 5,412,167 | A | 5/1995 | Mueller et al. | |
| 5,500,495 | A | 3/1996 | Benda et al. | |
| 5,577,599 | A | 11/1996 | Turek et al. | |
| 5,732,815 | A | 3/1998 | Brouwer | |
| 5,817,998 | A | 10/1998 | Siebels et al. | |
| 5,831,503 | A | 11/1998 | Beck et al. | |
| 6,043,439 | A * | 3/2000 | Crooks et al. | 200/50.33 |
| 6,096,986 | A * | 8/2000 | Flegel | 200/50.33 |
| 6,596,952 | B1 | 7/2003 | Degrazia et al. | |
| 6,727,441 | B2 | 4/2004 | Benda | |
| 6,737,594 | B2 | 5/2004 | Helms et al. | |
| 6,743,987 | B1 | 6/2004 | Remmert et al. | |
| 6,791,040 | B1 | 9/2004 | Puhalla et al. | |
| 6,940,027 | B1 | 9/2005 | Sipe | |

* cited by examiner

*Primary Examiner*—Kyung Lee
(74) *Attorney, Agent, or Firm*—Martin J. Moran

(57) ABSTRACT

A locking apparatus is for a circuit breaker including an enclosure having an opening with two sides and two ends, and two apertures on each of the sides proximate the ends. An operating mechanism includes a pivotal operating handle disposed through the opening. The operating handle includes a first position proximate one end of the opening and a second position proximate the other end of the opening. The locking apparatus is disposable proximate one of the ends of the opening. The locking apparatus includes a housing and a spring member interlocked with the housing. The spring member includes a first end and an opposite second end retained by the enclosure at the apertures at one of the ends when the operating handle is in the second position, or retained by the enclosure at the other apertures at the other of the ends when the handle is in the first position.

23 Claims, 6 Drawing Sheets

OPERATING HANDLE LOCKING APPARATUS AND ELECTRICAL SWITCHING APPARATUS INCLUDING THE SAME

BACKGROUND OF THE INVENTION

1. Field of the Invention

This invention pertains generally to electrical switching apparatus and, more particularly, to such electrical switching apparatus, such as circuit breakers. The invention also relates to locking apparatus for the operating handle of electrical switching apparatus.

2. Background Information

Electrical switching apparatus include, for example, circuit switching devices; circuit interrupters, such as circuit breakers; network protectors; contactors; motor starters; motor controllers; and other load controllers.

Circuit breakers are well known in the art. An example of a circuit breaker is disclosed in U.S. Pat. No. 5,341,191. Circuit breakers are used to protect electrical circuitry from damage due to an overcurrent condition, such as an overload condition or a relatively high level short circuit or fault condition. Molded case circuit breakers, for example, include at least one pair of separable contacts which are operated either manually by way of an operating handle disposed on the outside of the case or automatically by way of an internal trip unit in response to an overcurrent condition.

Circuit breakers typically have two or three possible operating handle positions, corresponding to the status of the separable contacts. For example, these positions may include an ON position, in which the separable contacts are closed, an OFF position in which the contacts are open, and a tripped position in which the contacts are tripped open. Typically, the handle position corresponding to the tripped position of the contacts is in between the ON and OFF positions.

In circuit breaker installations, for example in a panel board or load center, it is often desirable or essential that the settings of a single circuit breaker, or a group of circuit breakers, remain undisturbed. Unauthorized or inadvertent changing of the position of these breakers could result in annoying interruptions to service or operations, serious damage to an electrical apparatus, or even serious harm to a person. For example, accidental actuation of a circuit breaker might result in electrocution or shock to a person performing electrical work or repair within an office building or home. Therefore, to prevent, for example, another person from inadvertently returning the circuit breaker operating handle to the ON position when a worker is doing electrical work in an area other than the immediate vicinity of the circuit breaker box or electrical panel, safety measures must be taken. One such safety measure is the addition of a locking assembly to prevent displacement of the operating handle.

Although the main purpose of a circuit breaker is to trip during overload or short circuit conditions in order to protect downstream equipment and electrical wiring from damage, it may also be highly desirable to inhibit the circuit interruption function under certain conditions where, for example, the potential fire hazard of a non-opening circuit breaker is deemed to be a lesser hazard than if current flow to downstream devices is interrupted. The decision to accept the risk of fire over some other hazardous consequence may occur during emergencies or other critical situations where loss of life might occur if power is disrupted. Conceivable situations include, for example, circuit breakers employed in connection with combat (e.g., in a battleship under wartime conditions), fire-fighting (e.g., energizing pumps for pumping water to fire hoses in a high-rise building), spacecraft launch (e.g., energizing ground-based circuits critical to a safe launch), mining (e.g., energizing pumps employed to rapidly remove water from a flooded mine shaft), or nuclear power generation (e.g., energizing circuits critical to tripping a nuclear reactor). See, for example, U.S. Pat. No. 5,831,503. Although most circuit breakers can still trip internally even if the operating handle is held in the on position, a handle lock to prevent displacement of the operating handle would preclude manual operation that might inadvertently remove power in a critical situation.

U.S. Pat. Nos. 2,849,552; 3,214,530; 3,408,466; 4,347,412; 5,147,991; 5,219,070; 5,310,969; 5,412,167; 5,500,495; 5,577,599; and 5,732,815 disclose operating handle locking mechanisms consisting of an assembly of at least two parts and each employs a padlock to lock the handle of the circuit breaker in a fixed position. There are several disadvantages associated with known handle locking mechanisms of this type.

Many known locking mechanisms of this type employ a set or Allen screw to engage the operating handle, in order to prohibit its movement. See, for example, U.S. Pat. Nos. 2,849,552; 5,147,991; 5,500,495; and 5,732,815.

There is room for improvement in locking apparatus for electrical switching apparatus.

There is also room for improvement in electrical switching apparatus employing a locking apparatus.

SUMMARY OF THE INVENTION

These needs and others are met by embodiments of the invention, which provide a relatively simple and effective locking apparatus for an operating handle of an electrical switching apparatus, which locking apparatus comprises a housing and a spring member interlocked with the housing. The spring member comprises two ends structured to be retained by an electrical switching apparatus enclosure at corresponding apertures of an opening for the electrical switching apparatus operating handle in one of two positions thereof.

In accordance with one aspect of the invention, a locking apparatus is for an electrical switching apparatus comprising an enclosure including an opening having a first side, an opposite second side, a first end, and an opposite second end, the enclosure also including a first aperture on the first side and proximate the first end, a second aperture on the first side and proximate the opposite second end, a third aperture on the opposite second side and proximate the first end, and a fourth aperture on the opposite second side and proximate the opposite second end; separable contacts; an operating mechanism structured to open and close the separable contacts, the operating mechanism including an operating handle pivotally mounted with respect to the enclosure and disposed through the opening of the enclosure, the operating handle including a first position proximate the first end of the opening of the enclosure and a second position proximate the opposite second end of the opening of the enclosure, the locking apparatus being disposable proximate the first end of the opening of the enclosure when the operating handle is in the second position or being disposable proximate the opposite second end of the opening of the enclosure when the operating handle is in the first position. The locking apparatus comprises: a housing; and a spring member interlocked with the housing, the spring member comprising a first end and an opposite second end structured to be retained by the enclosure at the third aperture and the first aperture, respectively, proximate the first end of the opening of the enclosure when the operating handle is in the second position, or structured to be retained by the enclosure at the second aperture and the fourth aperture, respectively, proximate the opposite second end of the opening of the enclosure when the operating handle is in the first position.

The housing may comprise a first recess and a second recess; each of the first and second recesses may be structured to receive a hand tool; and the spring member may be structured to cooperate with the hand tool to move one of the first end and the opposite second end of the spring member away from one of the first, second, third and fourth apertures.

As another aspect of the invention, an electrical switching apparatus comprises: an enclosure comprising an opening having a first side, an opposite second side, a first end, and an opposite second end, the enclosure also comprising a first aperture on the first side and proximate the first end, a second aperture on the first side and proximate the opposite second end, a third aperture on the opposite second side and proximate the first end, and a fourth aperture on the opposite second side and proximate the opposite second end; separable contacts; an operating mechanism structured to open and close the separable contacts, the operating mechanism including an operating handle pivotally mounted with respect to the enclosure and disposed through the opening of the enclosure, the operating handle including a first position proximate the first end of the opening of the enclosure and a second position proximate the opposite second end of the opening of the enclosure; and a locking apparatus disposed proximate the first end of the opening of the enclosure when the operating handle is in the second position or disposed proximate the opposite second end of the opening of the enclosure when the operating handle is in the first position, the locking apparatus comprising: a housing, and a spring member interlocked with the housing of the locking apparatus, the spring member comprising a first end and an opposite second end retained by the enclosure at the third aperture and the first aperture, respectively, proximate the first end of the opening of the enclosure when the operating handle is in the second position, or retained by the enclosure at the second aperture and the fourth aperture, respectively, proximate the opposite second end of the opening of the enclosure when the operating handle is in the first position.

The enclosure may further comprise a first surface including the opening thereon; the operating handle may comprise a second surface proximate the opening and a third surface extending away from the second surface and the opening; the housing of the locking apparatus may comprise fourth surface engaging the first surface, a fifth surface proximate the second surface, and a sixth surface engaging the third surface; and the housing may block the operating handle from moving from one of: (a) the first position to the second position when the first end and the opposite second end of the spring member are retained by the enclosure at the second aperture and the fourth aperture, respectively; and (b) the second position to the first position when the first end and the opposite second end of the spring member are retained by the enclosure at the third aperture and the first aperture, respectively.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "hand tool" means an insertion hand tool and/or a removal hand tool, such as, for example and without limitation, a flat blade, flathead or slotted screwdriver.

The invention is described in association with a circuit breaker, although the invention is applicable to a wide range of electrical switching apparatus.

Figure 1:
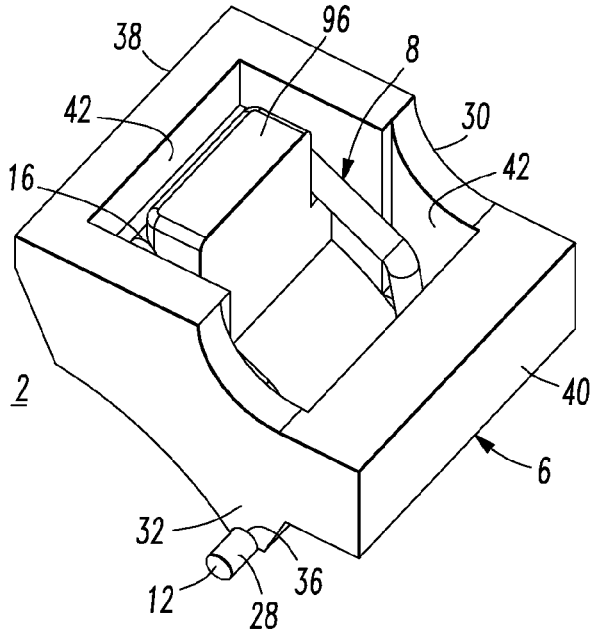
FIG. 1 is an isometric view of a locking device in accordance with embodiments of the invention.
Figure 4:
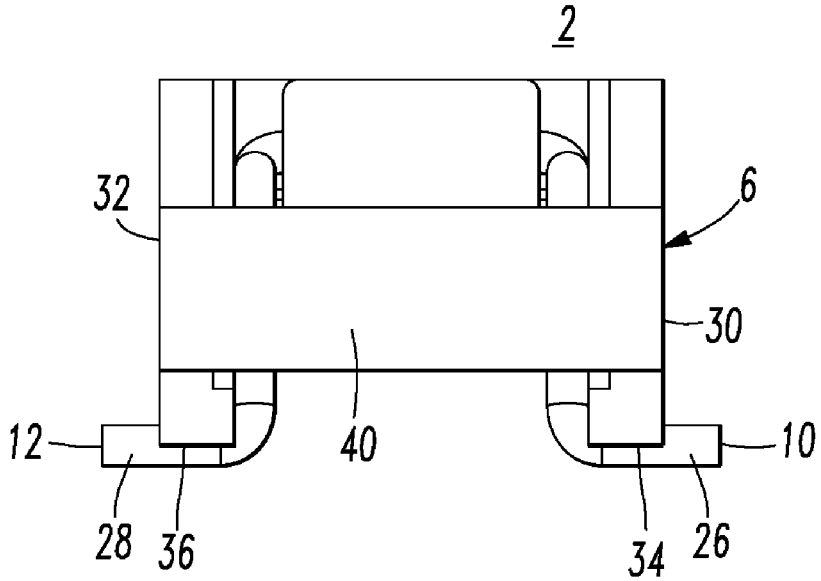

Referring to FIGS. 1-4, a locking apparatus, such as the example locking device 2, is for an electrical switching apparatus, such as the example circuit breaker 4 of FIGS. 5-9. The example locking device 2 includes a housing, such as the example molded housing 6, and a spring member, such as the example flexible U-shaped spring 8, which is interlocked with the housing 6 (e.g., as shown in FIGS. 1 and 4 between the internal tab 96 and the external recesses 34,36). The spring 8 includes a first end 10 and an opposite second end 12. The spring 8 further includes a U-shaped portion 14 having a base 16 with two ends 18,20, a first leg 22 disposed from the first end 18, and a second leg 24 disposed from the second end 20. The spring 8 further includes a first foot 26 disposed from the first leg 22 and a second foot 28 disposed from the second leg 24. The first foot 26 forms the first end 10 of the spring 8, and the second foot 28 forms the opposite second end 12 of the spring 8.

The example molded housing 6 includes a first side 30 (also shown in FIG. 6) and an opposite second side 32. The housing sides 30 and 32 include first and second recesses 34 (shown in FIG. 6) and 36, respectively. The first foot 26 of the spring 8 rests in the first recess 34, and the second spring foot 28 rests in the second recess 36. The housing 6 further includes a first end 38 and an opposite second end 40. The base 16 of the U-shaped portion 14 of the spring 8 rests in a cavity 42 (also shown in FIG. 7) proximate the first end 38 of the housing 6. The first leg 22 of the spring 8 includes a first leg portion 44 disposed from the base 16, a second leg portion 46, and a first bend portion 48 between the first and second leg portions 44,46. The second leg portion 46 is proximate the opposite second end 40 of the housing 6. The second leg 24 of the spring 8 includes a third leg portion 50 disposed from the base 16, a fourth leg portion 52, and a second bend portion 54 between the third and fourth leg portions 50,52. The fourth leg portion 52 is proximate the opposite second end 40 of the housing 6.

Referring to FIGS. 5-8, the example circuit breaker 4 includes an enclosure, such as the example molded enclosure (e.g., molded case) 56 having an opening 58, separable contacts 60 (shown in simplified form in FIGS. 5 and 8) and an operating mechanism 62 (shown in simplified form in FIG. 5) structured to open and close the separable contacts 60. The operating mechanism 62 includes an operating handle 64 pivotally mounted with respect to the enclosure 56 and disposed through the enclosure opening 58.

Figure 5:
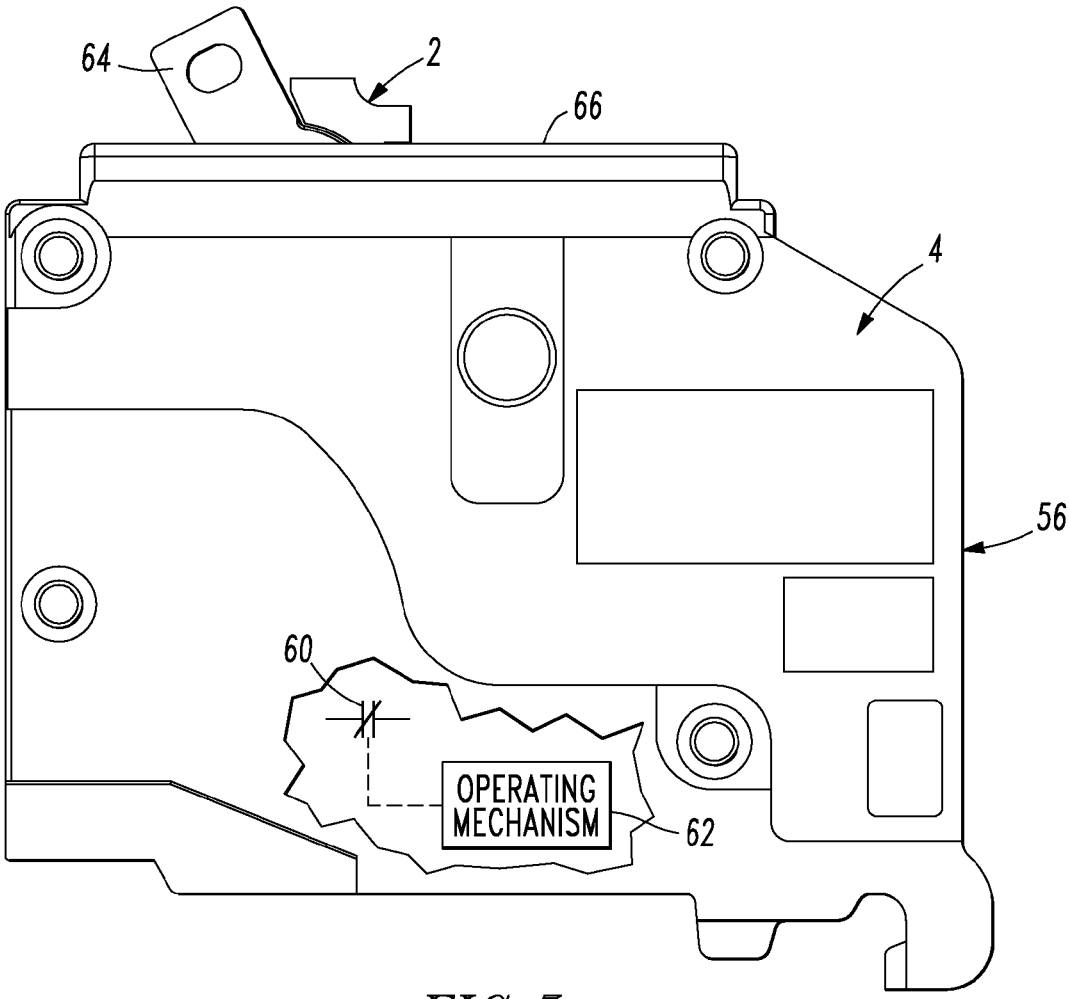
FIG. 5 is a vertical elevation view of a circuit breaker including the locking device of FIG. 1 in the lock-on position.
Figure 6:
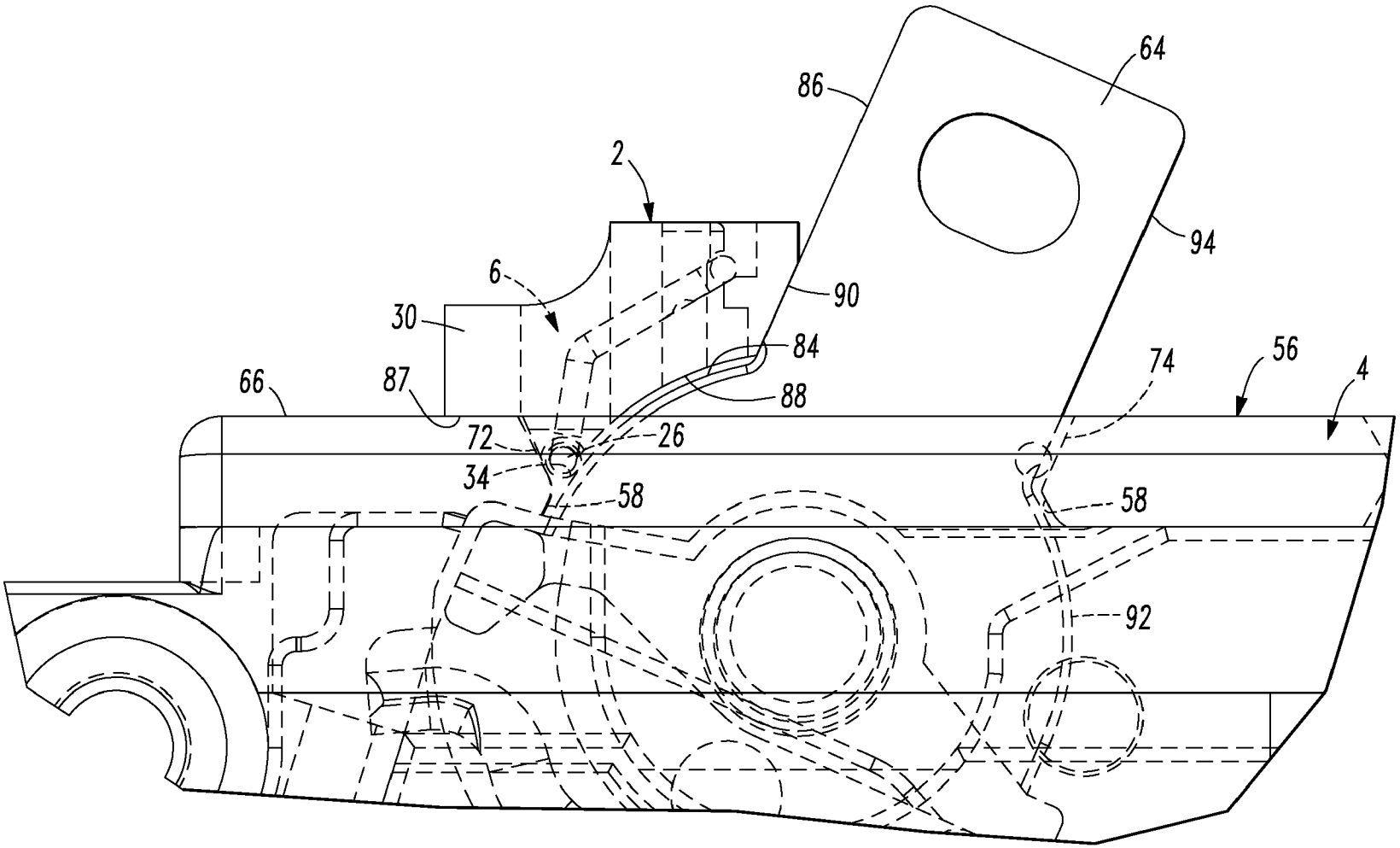
FIG. 6 is a vertical elevation view of a portion of the circuit breaker of FIG. 5, except including the locking device in the lock-off position.
Figure 7:
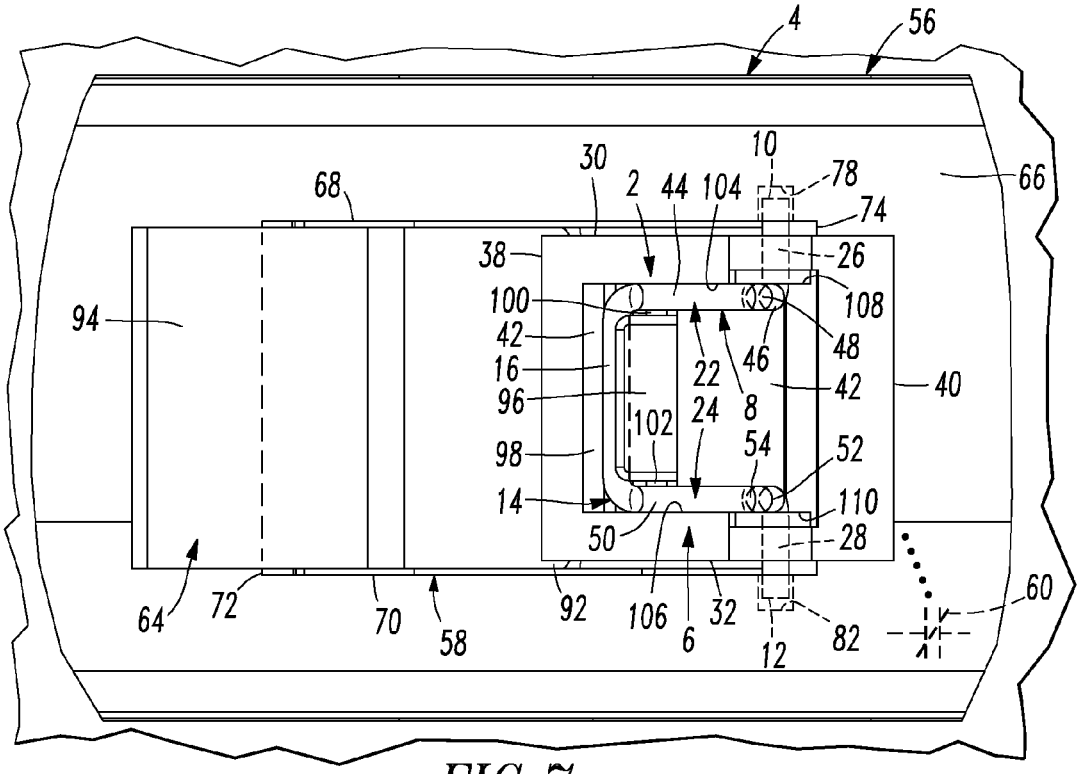
FIG. 7 is a top plan view of a circuit breaker including the locking device of FIG. 1 in the lock-on position.
Figure 8:
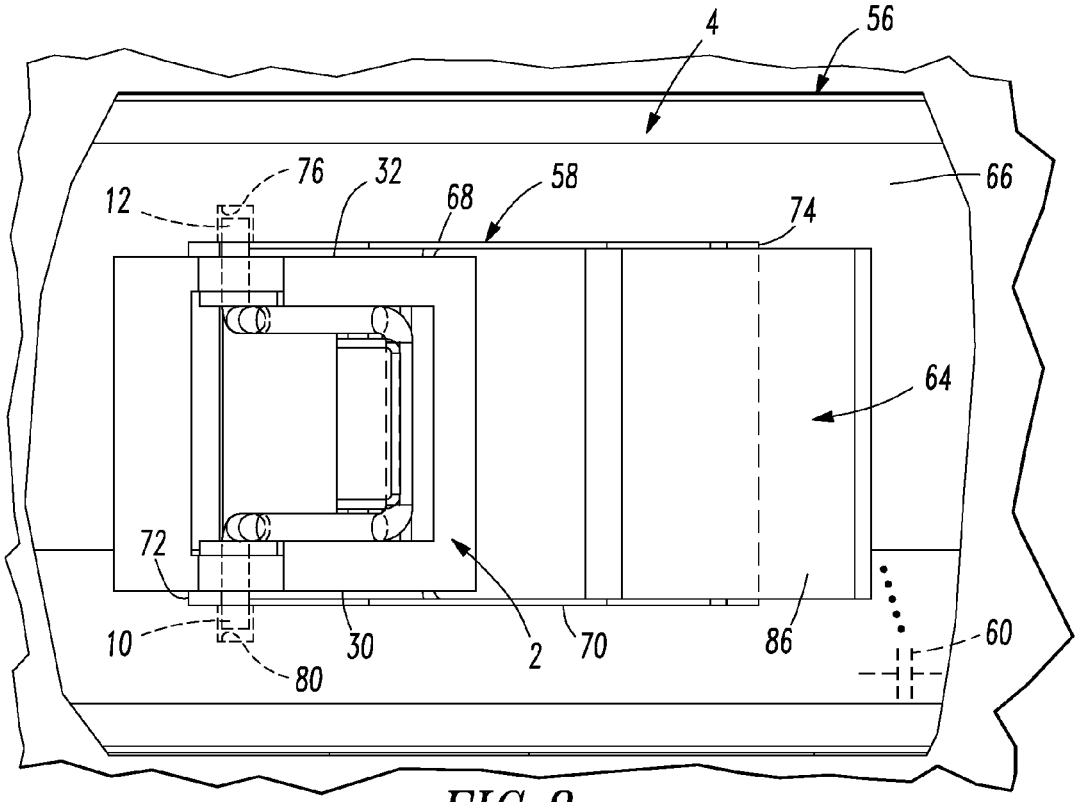
FIG. 8 is a top plan view of a circuit breaker including the locking device of FIG. 1 in the lock-off position.

As shown in FIGS. 7 and 8, the opening 58 is on the top surface 66 of the circuit breaker enclosure 56 and has a first side 68, an opposite second side 70, a first end 72, and an opposite second end 74. The enclosure 56 also includes a first aperture 76 on the first side 68 and proximate the first end 72, a second aperture 78 on the first side 68 and proximate the opposite second end 74, a third aperture 80 on the opposite second side 70 and proximate the first end 72, and a fourth aperture 82 on the opposite second side 70 and proximate the opposite second end 74. The operating handle 64 includes a first position (e.g., ON) (FIGS. 5 and 7) proximate the first end 72 of the enclosure opening 58 and a second position (e.g., OFF) (FIGS. 6 and 8) proximate the opposite second end 74 of the enclosure opening 58. The separable contacts 60 (FIGS. 5 and 8) include an open state (FIG. 8) and a closed state (FIG. 5). In the example, as shown, the position of the operating handle 64 in FIGS. 5 and 7 corresponds to the closed state of the separable contacts 60, and the position of the operating handle 64 in FIGS. 6 and 8 corresponds to the open state of the separable contacts 60.

The locking device 2 is disposed proximate the first end 72 of the enclosure opening 58 when the operating handle 64 is in the second, open position (FIGS. 6 and 8) and, alternatively, is disposed proximate the opposite second end 74 of the enclosure opening 58 when the operating handle 64 is in the first, on position (FIGS. 5 and 7).

As best shown in FIGS. 3, 4, 7 and 8, the first end 10 of the spring 8 extends beyond the first side 30 of the housing 6 and is structured to enter into one of the second and third apertures 78,80, and the opposite second end 12 of the spring 8 extends beyond the opposite second housing side 32 and is structured to enter into one of the first and fourth apertures 76,82. As shown in FIG. 7, the circuit breaker enclosure 56 is structured to retain, at the apertures 82,78, the spring ends 12,10, respectively, of the locking device 2 proximate the second end 74 of the enclosure opening 58 when the operating handle 64 is in the first, closed position. Alternatively, as shown in FIG. 8, the circuit breaker enclosure 56 is structured to retain, at the apertures 76,80, the spring ends 12,10, respectively, of the locking device 2 proximate the first end 72 of the enclosure opening 58 when the operating handle 64 is in the second, open position.

As shown in FIGS. 5-8, the circuit breaker enclosure 56 includes the top surface 66, which is a first planar surface including the opening 58 (FIGS. 7 and 8) thereon. Continuing to refer to FIG. 6, the operating handle 64 includes a second arcuate surface 84 proximate the opening 58 and a third planar surface 86 (best shown in FIG. 8) extending away from the second arcuate surface 84 and the opening 58. The housing 6 of the locking device 2 includes a fourth planar surface 87 engaging the first planar surface 66, a fifth arcuate surface 88 proximate the second arcuate surface 84, and a sixth planar surface 90 engaging the third planar surface 86. The operating handle 64 also includes a seventh arcuate surface 92 proximate the opening 58 and an eighth planar surface 94 (best shown in FIG. 7) extending away from the seventh arcuate surface 92 and the opening 58. It will be appreciated that in the position of the locking device 2 shown in FIGS. 5 and 7, the fourth planar surface 87 engages the first planar surface 66, the fifth arcuate surface 88 is proximate the seventh arcuate surface 92, and the sixth planar surface 90 engages the eighth planar surface 94.

The housing 6 of the locking device 2 advantageously blocks the operating handle 64 of FIG. 7 from moving from the first, closed position to the second, off position (FIGS. 6 and 8) when the ends 12 and 10 of the spring 8 are retained by the circuit breaker enclosure 56 at the respective apertures 82 and 78. Similarly, the housing 6 of the locking device 2 advantageously blocks the operating handle 64 of FIG. 8 from moving from the second, off position to the first, on position (FIGS. 5 and 7) when the ends 12 and 10 of the spring 8 are retained by the circuit breaker enclosure 56 at the respective apertures 76 and 80.

The locking device housing 6 includes the first side 30, the opposite second side 32, the first end 38 and the opposite second end 40. The housing cavity 42 houses the U-shaped portion 14 of the spring 8 including the base 16, the first leg 22, the second leg 24, a portion of the first foot 26, and a portion of the second foot 28. The cavity 42 is disposed between the first end 38 and the opposite second end 40, and between the first side 30 and the opposite second side 32 of the housing 6.

In the position of FIG. 7, the first side 30 of the housing 6 is proximate the circuit breaker enclosure 56 at the first side 68 of the opening 58, and the opposite second side 32 of the housing 6 is proximate the enclosure 56 at the opposite second side 70 of the opening 58. Conversely, in the position of FIG. 8, the first side 30 of the housing 6 is proximate the circuit breaker enclosure 56 at the opposite second side 70 of the opening 58, and the opposite second side 32 of the housing 6 is proximate the enclosure 56 at the first side 68 of the opening 58.

Figure 2:
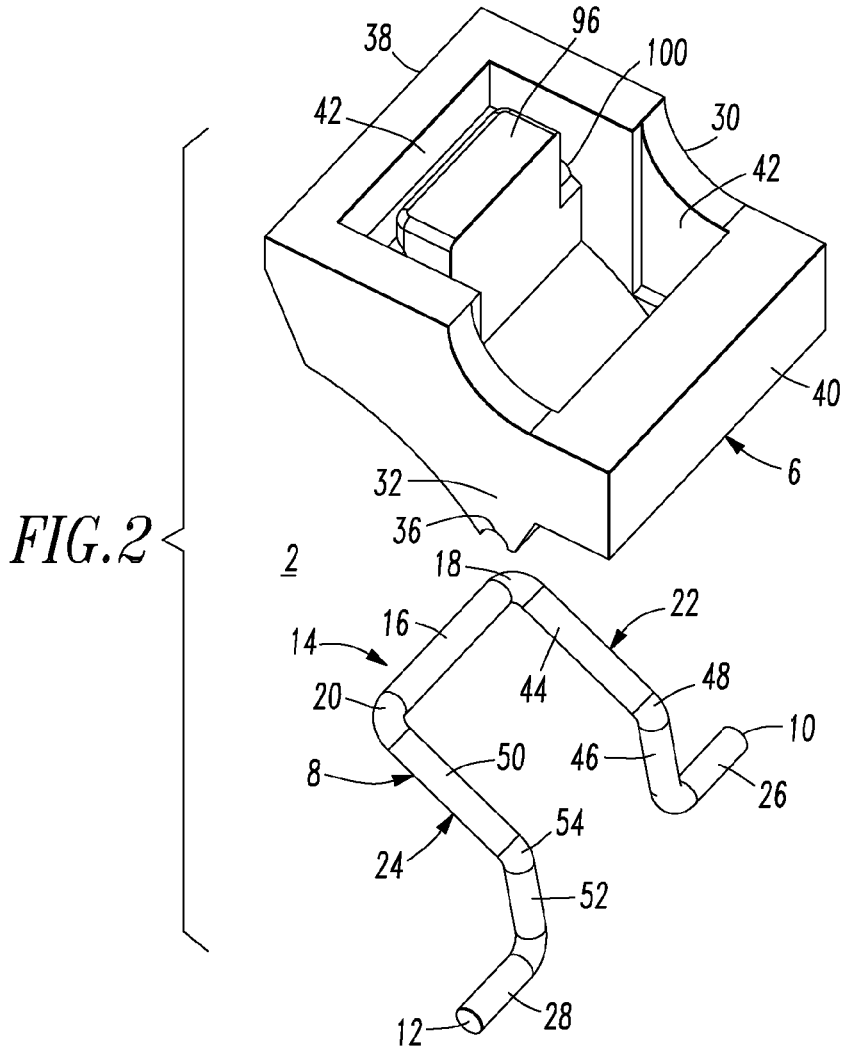
FIG. 2 is an exploded isometric view of a molded housing and a flexible spring of the locking device of FIG. 1.
Figure 3:
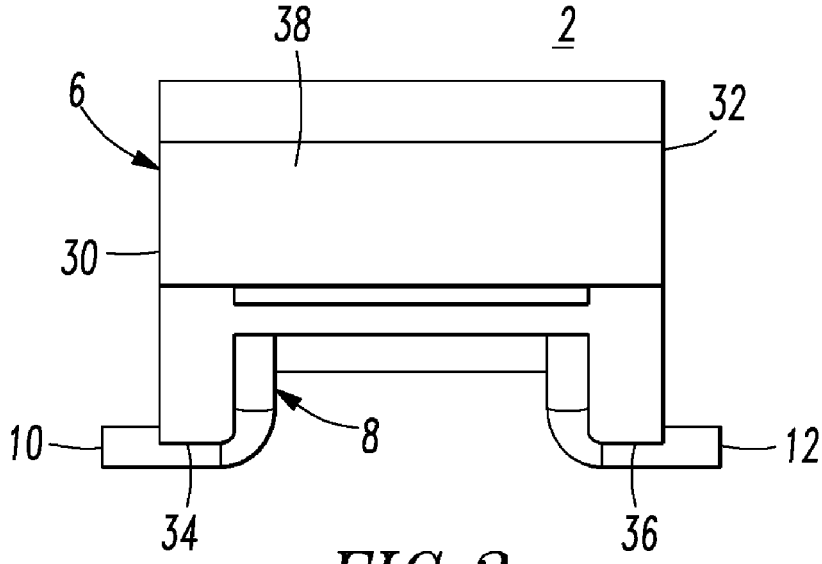
FIGS. 3 and 4 are end elevation views of the locking device of FIG. 1.

As best shown in FIG. 2, the housing 6 includes a tab 96 in the cavity 42. The tab 96 is separated from the ends 38,40 and the sides 30,32, is proximate the first end 38 and is distal from the opposite second end 40. As shown in FIG. 7, the base 16 of the U-shaped portion 14 of the spring 8 is proximate the first housing end 38, engages the tab 96 and is supported by an internal housing surface 98. The first leg portion 44 is disposed between the tab 96 and the first housing side 30, and the third leg portion 50 is disposed between the tab 96 and the opposite second housing side 32. The tab 96 includes a first shoulder 100 (also shown in FIG. 2) supporting the first leg portion 44 and a second shoulder 102 supporting the third leg portion 50. The first leg portion 44 engages the internal surface 104 of the first housing side 30, and the third leg portion 50 engages the internal surface 106 of the opposite second housing side 32.

Figure 9:
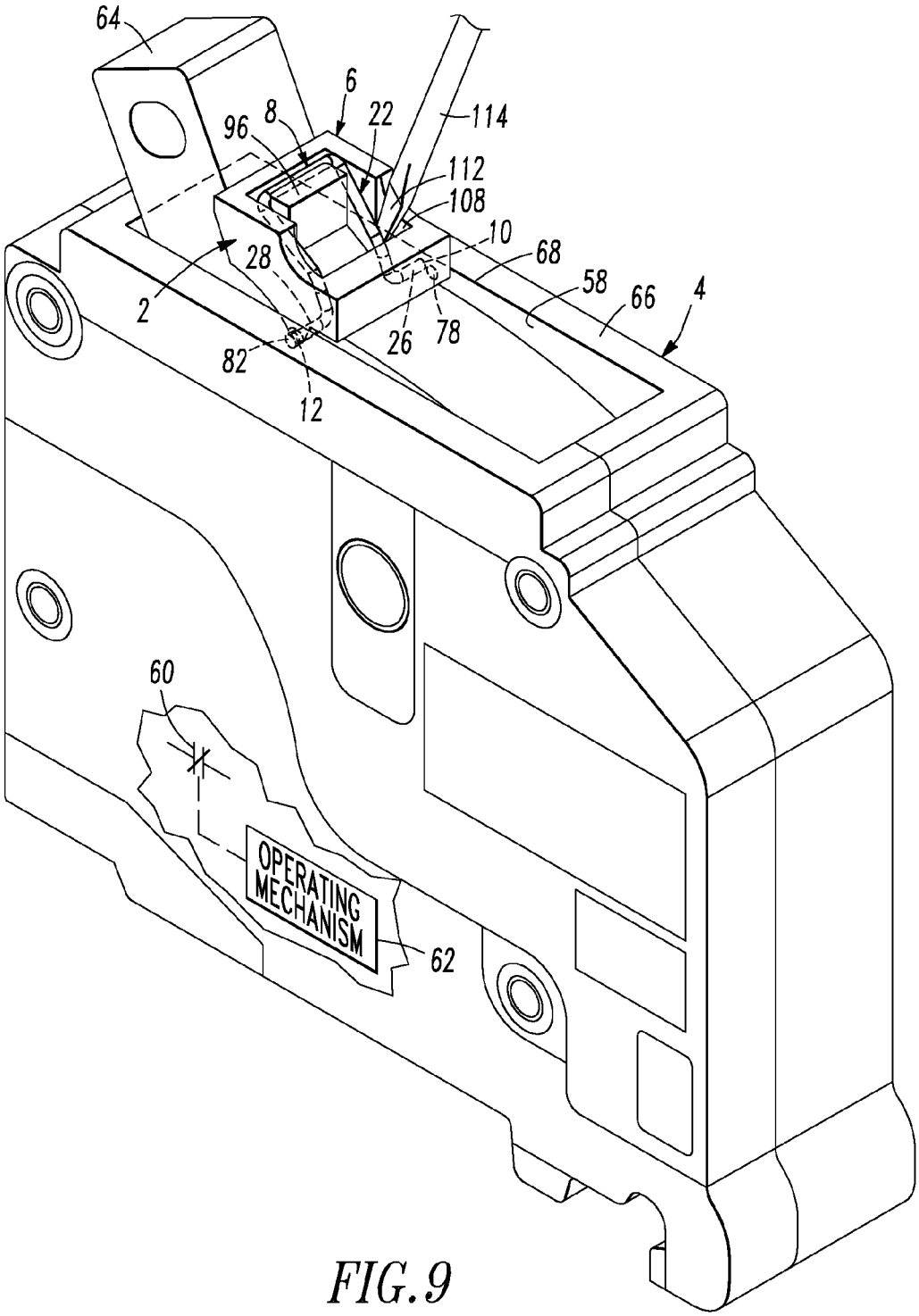
FIG. 9 is an isometric view showing a circuit breaker including the locking device of FIG. 1 as it is being inserted into or removed from the lock-on position.

Still referring to FIG. 7, the first housing side 30 includes a first recess 108, and the opposite second housing side 32 includes a second recess 110. The first bend portion 48 and the second leg portion 46 of the spring 8 are offset by the first recess 108 from the first housing side 30, and the second bend portion 54 and the fourth leg portion 52 of the spring 8 are offset by the second recess 110 from the opposite second housing side 32. As shown in FIG. 9, the first and second recesses 108,110 are structured to receive a hand tool, such as the example flat blade 112 of the example flat blade screwdriver 114. The spring 8 cooperates with the example flat blade 112 to move one (e.g., end 10 of FIG. 9) of the first end 10 and the opposite second end 12 of the spring 8 away from one of the first, second, third and fourth circuit breaker apertures 76,78,80,82 (e.g., aperture 78 of FIG. 9).

When one of the two ends 10,12 of the spring 8 (e.g., end 10 of FIG. 9) is compressed by using a suitable hand tool, then there is sufficient clearance between the locking device housing 6 and the circuit breaker opening 58 to allow the locking device 2 to "pop out" when it is pivoted upward about the other of the two ends 10,12 (e.g., end 12 of FIG. 9). The insertion process is the reverse of this. One of the two ends 10,12 of the spring 8 (e.g., end 12 of FIG. 9) is retained by the circuit breaker enclosure 56 at one of its four apertures 76,78,80,82 (e.g., aperture 82) when the locking device 2 is inserted and pivoted downward about such one of the two ends 10,12 (e.g., end 12 of FIG. 9). There is sufficient clearance between the locking device housing 6 and the circuit breaker opening 58 when the spring 8 is compressed on the other of those two ends 10,12 (e.g., end 10 of FIG. 9) by using the same or similar hand tool. This allows the locking device 2 to "pop in" when it is pivoted downward about such one of the two ends 10,12 (e.g., end 12 of FIG. 9). Then, when the hand tool is withdrawn, the opposite end (e.g., end 10 of FIG. 9) of the spring 8 is retained by the circuit breaker enclosure 56 at the opposite one of the apertures 76,78,80,82 (e.g., aperture 78).

Although FIG. 9 shows the locking device 2 being inserted into or removed from the lock-on position by compressing the spring end 10 at the recess 108, it will be appreciated that the same or similar procedure may be employed for the lock-off position and/or for the spring end 12.

The circuit breaker molded enclosure 56 captures the example quick release spring 8 of the locking device 2, which is easy to install for either one of the "ON" (FIGS. 5 and 7) and the "OFF" (FIGS. 6 and 8) circuit breaker positions.

The example locking device 2 can easily be removed by simply inserting a hand tool, such as the example flat blade 112 of the screwdriver 114 into one of the two recesses 108,110 on either side of the device housing 6 and rotating the locking device 2 out of the circuit breaker 4.

The example two-piece assembly 6,8 of the disclosed locking device 2 provides the user with the ability to lock the example circuit breaker operating handle 64 in either the "ON" or "OFF" position while requiring minimal space for installation in the operating handle opening 58.

The example molded housing 6 of the locking device 2 is much safer than a single piece, metal version, which would be more difficult to install and would have relatively sharp edges.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A locking apparatus for an electrical switching apparatus comprising an enclosure including an opening having a first side, an opposite second side, a first end, and an opposite second end, said enclosure also including a first aperture on the first side and proximate the first end, a second aperture on the first side and proximate the opposite second end, a third aperture on the opposite second side and proximate the first end, and a fourth aperture on the opposite second side and proximate the opposite second end; separable contacts; an operating mechanism structured to open and close said separable contacts, said operating mechanism including an operating handle pivotally mounted with respect to said enclosure and disposed through the opening of said enclosure, said operating handle including a first position proximate the first end of the opening of said enclosure and a second position proximate the opposite second end of the opening of said enclosure, said locking apparatus being disposable proximate the first end of the opening of said enclosure when said operating handle is in said second position or being disposable proximate the opposite second end of the opening of said enclosure when said operating handle is in said first position, said locking apparatus comprising:

a housing; and a spring member interlocked with said housing, said spring member comprising a first end and an opposite second end structured to be retained by said enclosure at the third aperture and the first aperture, respectively, proximate the first end of the opening of said enclosure when said operating handle is in said second position, or structured to be retained by said enclosure at the second aperture and the fourth aperture, respectively, proximate the opposite second end of the opening of said enclosure when said operating handle is in said first position.

2. The locking apparatus of claim 1 wherein said housing is a molded housing.

3. The locking apparatus of claim 1 wherein said housing comprises a first recess and a second recess; wherein each of the first and second recesses is structured to receive a hand tool; and wherein said spring member is structured to cooperate with said hand tool to move one of the first end and the opposite second end of said spring member away from one of the first, second, third and fourth apertures.

4. The locking apparatus of claim 1 wherein said enclosure further comprises a first planar surface including said opening thereon; wherein said operating handle comprises a second arcuate surface proximate said opening and a third planar surface extending away from the second arcuate surface and said opening; and wherein said housing comprises fourth planar surface structured to engage said first planar surface, a fifth arcuate surface structured to be proximate said second arcuate surface, and a sixth planar surface structured to engage said third planar surface.

5. The locking apparatus of claim 1 wherein said spring member further comprises a U-shaped portion including a base having two ends, a first leg disposed from one of said two ends, and a second leg disposed from the other one of said two ends, said spring member further comprising a first foot disposed from said first leg and a second foot disposed from said second leg, said first foot forming the first end of said spring member, said second foot forming the opposite second end of said spring member.

6. The locking apparatus of claim 5 wherein said housing comprises a first side and an opposite second side; wherein the first side of said housing includes a first recess; wherein the opposite second side of said housing includes a second recess; wherein the first foot of said spring member rests in the first recess; and wherein the second foot of said spring member rests in the second recess.

7. The locking apparatus of claim 5 wherein said housing comprises a first side, an opposite second side, and a cavity housing said U-shaped portion including the base, the first leg, the second leg, a portion of the first foot, and a portion of the second foot, said first foot forming the first end of said spring member, said second foot forming the opposite second end of said spring member; wherein the first end of said spring member extends beyond the first side of said housing and is structured to enter into one of the second aperture and the third aperture; and wherein the opposite second end of said spring member extends beyond the opposite second side of said housing and is structured to enter into one of the fourth aperture and the first aperture.

8. The locking apparatus of claim 7 wherein said housing further comprises a first end and an opposite second end; wherein the base of said U-shaped portion rests in the cavity proximate the first end of said housing; wherein said first leg includes a first leg portion disposed from said base, a second leg portion, and a first bend portion between the first and second leg portions, said second leg portion being proximate the opposite second end of said housing; and wherein said second leg includes a third leg portion disposed from said base, a fourth leg portion, and a second bend portion between the third and fourth leg portions, said fourth leg portion being proximate the opposite second end of said housing.

9. The locking apparatus of claim 8 wherein said cavity is disposed between the first end and the opposite second end of said housing, and between the first side and the opposite second side of said housing; wherein said housing further comprises a tab in said cavity, said tab being separated from the first end, the opposite second end, the first side and the opposite second side of said housing, said tab being proximate the first end of said housing and being distal from the opposite second end of said housing; wherein the base of said U-shaped portion is proximate the first end of said housing and engages the tab of said housing; wherein the first leg portion is disposed between said tab and the first side of said housing; and wherein the third leg portion is disposed between said tab and the opposite second side of said housing.

10. The locking apparatus of claim 9 wherein said tab includes a first shoulder supporting the first leg portion and a second shoulder supporting the third leg portion; wherein the first leg portion engages the first side of said housing; wherein the third leg portion engages the opposite second side of said housing; wherein the first side of said housing includes a first recess; wherein the opposite second side of said housing includes a second recess; wherein the first bend portion and the second leg portion are offset by the first recess from the first side of said housing; wherein the second bend portion and the fourth leg portion are offset by the second recess from the opposite second side of said housing; and wherein each of the first and second recesses is structured to receive a hand tool.

11. An electrical switching apparatus comprising:

an enclosure comprising an opening having a first side, an opposite second side, a first end, and an opposite second end, said enclosure also comprising a first aperture on the first side and proximate the first end, a second aperture on the first side and proximate the opposite second end, a third aperture on the opposite second side and proximate the first end, and a fourth aperture on the opposite second side and proximate the opposite second end;

separable contacts;

an operating mechanism structured to open and close said separable contacts, said operating mechanism including an operating handle pivotally mounted with respect to said enclosure and disposed through the opening of said enclosure, said operating handle including a first position proximate the first end of the opening of said enclosure and a second position proximate the opposite second end of the opening of said enclosure; and a locking apparatus disposed proximate the first end of the opening of said enclosure when said operating handle is in said second position or disposed proximate the opposite second end of the opening of said enclosure when said operating handle is in said first position, said locking apparatus comprising:

a housing, and a spring member interlocked with the housing of said locking apparatus, said spring member comprising a first end and an opposite second end retained by said enclosure at the third aperture and the first aperture, respectively, proximate the first end of the opening of said enclosure when said operating handle is in said second position, or retained by said enclosure at the second aperture and the fourth aperture, respectively, proximate the opposite second end of the opening of said enclosure when said operating handle is in said first position.

12. The electrical switching apparatus of claim 11 wherein the housing of said locking apparatus is a molded housing.

13. The electrical switching apparatus of claim 11 wherein said separable contacts include an open state and a closed state; wherein the first position of the operating handle corresponds to the closed state of said separable contacts; and wherein the second position of the operating handle corresponds to the open state of said separable contacts.

14. The electrical switching apparatus of claim 13 wherein said enclosure further comprises a first surface including said opening thereon; wherein said operating handle comprises a second surface proximate said opening and a third surface extending away from the second surface and said opening; wherein the housing of said locking apparatus comprises fourth surface engaging said first surface, a fifth surface proximate said second surface, and a sixth surface engaging said third surface; and wherein said housing blocks said operating handle from moving from one of: the first position to the second position when the first end and the opposite second end of said spring member is retained by said enclosure at the second aperture and the fourth aperture, respectively; and the second position to the first position when the first end and the opposite second end of said spring member is retained by said enclosure at the third aperture and the first aperture, respectively.

15. The electrical switching apparatus of claim 11 wherein said enclosure further comprises a first planar surface including said opening thereon; wherein said operating handle comprises a second arcuate surface proximate said opening and a third planar surface extending away from the second arcuate surface and said opening; and wherein the housing of said locking apparatus comprises fourth planar surface engaging said first planar surface, a fifth arcuate surface proximate said second arcuate surface, and a sixth planar surface engaging said third planar surface.

16. The electrical switching apparatus of claim 11 wherein said spring member further comprises a U-shaped portion including a base having two ends, a first leg disposed from one of said two ends, and a second leg disposed from the other one of said two ends, said spring member further comprising a first foot disposed from said first leg and a second foot disposed from said second leg, said first foot forming the first end of said spring member, said second foot forming the opposite second end of said spring member.

17. The electrical switching apparatus of claim 16 wherein said housing comprises a first side and an opposite second side; wherein the first side of said housing includes a first recess; wherein the opposite second side of said housing includes a second recess; wherein the first foot of said spring member rests in the first recess; and wherein the second foot of said spring member rests in the second recess.

18. The electrical switching apparatus of claim 16 wherein the housing of said locking apparatus comprises a first side, an opposite second side, and a cavity housing said U-shaped portion including the base, the first leg, the second leg, a portion of the first foot, and a portion of the second foot, said first foot forming the first end of said spring member, said second foot forming the opposite second end of said spring member; wherein the first end of said spring member extends beyond the first side of said housing and into one of the second aperture and the third aperture; and wherein the opposite second end of said spring member extends beyond the opposite second side of said housing and into one of the fourth aperture and the first aperture.

19. The electrical switching apparatus of claim 18 wherein the housing of said locking apparatus further comprises a first end and an opposite second end; wherein the base of said U-shaped portion rests in the cavity proximate the first end of said housing; wherein said first leg includes a first leg portion disposed from said base, a second leg portion, and a first bend portion between the first and second leg portions, said second leg portion being proximate the opposite second end of said housing; and wherein said second leg includes a third leg portion disposed from said base, a fourth leg portion, and a second bend portion between the third and fourth leg portions, said fourth leg portion being proximate the opposite second end of said housing.

20. The electrical switching apparatus of claim 19 wherein said cavity is disposed between the first end and the opposite second end of said housing, and between the first side and the opposite second side of said housing; wherein the housing of said locking apparatus further comprises a tab in said cavity, said tab being separated from the first end, the opposite second end, the first side and the opposite second side of said housing, said tab being proximate the first end of said housing and being distal from the opposite second end of said housing; wherein the base of said U-shaped portion is proximate the first end of said housing and engages the tab of said housing; wherein the first leg portion is disposed between said tab and the first side of said housing; and wherein the third leg portion is disposed between said tab and the opposite second side of said housing.

21. The electrical switching apparatus of claim 20 wherein said tab includes a first shoulder supporting the first leg portion and a second shoulder supporting the third leg portion.

22. The electrical switching apparatus of claim 20 wherein the first leg portion engages the first side of said housing; wherein the third leg portion engages the opposite second side of said housing; wherein the first side of said housing includes a first recess; wherein the opposite second side of said housing includes a second recess; wherein the first bend portion and the second leg portion are offset by the first recess from the first side of said housing; and wherein the second bend portion and the fourth leg portion are offset by the second recess from the opposite second side of said housing.

23. The electrical switching apparatus of claim 22 wherein each of the first and second recesses is structured to receive a hand tool.

* * * * *